United States Patent [19]

Kakinaka

[11] Patent Number: 4,614,311

[45] Date of Patent: Sep. 30, 1986

[54] YARN STORAGE AND DELIVERY APPARATUS

[75] Inventor: Shoichiro Kakinaka, Nishinomiya, Japan

[73] Assignee: Kasuga Denki Co., Ltd., Osaka, Japan

[21] Appl. No.: 696,643

[22] Filed: Jan. 30, 1985

[51] Int. Cl.[4] ..... B65H 51/20

[52] U.S. Cl. ..... 242/47.01; 139/452

[58] Field of Search ..... 242/47.01, 47.12, 47; 57/67, 68, 71; 66/132 R, 132 T; 139/452

[56] References Cited

U.S. PATENT DOCUMENTS

| | | | |
|---|---|---|---|
| 3,174,270 | 3/1965 | Blaschke | 57/67 |
| 3,761,031 | 9/1973 | Pfarrwaller | 242/47.01 |
| 3,791,598 | 2/1974 | Vischiani et al. | 242/47.12 |
| 3,834,635 | 9/1974 | Pfarrwaller | 242/47.01 |
| 4,050,640 | 9/1977 | Henrich | 242/47 X |

*Primary Examiner*—Stanley N. Gilreath

*Attorney, Agent, or Firm*—W. G. Fasse; D. H. Kane, Jr.

[57] ABSTRACT

A yarn wrapping member 15 and a yarn winding drum 17 are rotated in opposite directions to wrap the yarn around the yarn winding drum 17 for storage. Accordingly, the yarn speed is the sum of the rotative speed of the yarn wrapping member 15 and the reverse rotative speed of the yarn winding drum 17.

6 Claims, 3 Drawing Figures

YARN STORAGE AND DELIVERY APPARATUS

BACKGROUND OF THE INVENTION

1. Field of the Invention

This invention relates to a yarn storage and delivery apparatus and particularly to a yarn storage and delivery apparatus used to feed a yarn under constant tension.

2. Description of the Prior Art

As is known, weaving machines use a yarn storage and delivery apparatus for feeding a weft yarn under constant tension. Such yarn storage and delivery apparatus is used not only for feeding a weft yarn to a weaving machine but also in winders.

There are two types of known yarn storage and delivery apparatuses, the yarn winding drum rotation type or the so-called Savi type and the yarn winding drum stationary type or the so-called Sulzer type. A yarn storage and delivery apparatus of the Savi type keeps the yarn wrapping member stationary while rotatively driving the yarn winding drum to wrap a predetermined amount of yarn therearound for storage. When the weaving machine starts operating, the yarn on the yarn winding drum is unwound therefrom under constant tension to be fed to the weaving machine. Concurrently therewith, the yarn winding drum is rotated to make up for the amount of unwound yarn. That is, while the yarn on the yarn winding drum is being withdrawn, additional yarn is wrapped therearound.

On the other hand, a yarn storage and delivery apparatus of the Sulzer type keeps the yarn winding drum stationary while rotating the yarn wrapping member to wrap a predetermined amount of yarn around the yarn winding drum. As soon as the yarn comes to be unwound, the yarn wrapping member is started to make up for the yarn consumption.

The features and merits and demerits of both types will now be described.

In the Savi type yarn storage and delivery apparatus, since the yarn winding drum is kept rotating all the time, the yarn is caused to balloon even during intermittent delivery of yarn and hence there is little possibility of snarls being formed. Accordingly, the Savi type yarn storage and delivery apparatus is suitable for hard twist yarns. However, if the yarn speed exceeds 800 m/min, the use of a tension ring fitted on the yarn winding drum results in the tension ring finger spreading to decrease the tension until the latter is zero. For this reason, the Savi type has been limited in practical yarn speed to no more than 900 m/min.

On the other hand, in the Sulzer type yarn storage and delivery apparatus, since the yarn winding drum is kept stationary, the yarn hangs down at rest during intermittent delivery of yarn, tending to produce snarls. Thus, this type is not suitable for use with hard twist yarns. The Sulzer type has a feature that there is no variation in tension taking place even when the yarn speed is above 800 m/min, since the tension ring is kept at rest. However, if the yarn speed exceeds 1200 m/min, the yarn wrapping rate becomes so high as to cause yarn breakage which is dangerous. Thus, the Savi type is suitable for use at low yarn speeds of not more than 800 m/min, while the Sulzer type is suitable for use at high yarn speeds of not less than 800 m/min. Both types, however, have the disadvantage of not being applicable to high speed yarn delivery in which the yarn speed exceeds 1200 m/min.

SUMMARY OF THE INVENTION

An object of this invention is to provide a yarn storage and delivery apparatus which is free of the disadvantages of both the yarn winding drum rotation type and the yarn winding drum stationary type while combining the advantageous features of both types and which enables a high speed delivery to be attained under constant yarn tension even when the yarn speed is above 1200 m/min.

In brief, the apparatus of this invention includes a yarn wrapping member and a yarn winding drum which are rotatably supported, said yarn winding drum being adapted to be rotated in the direction opposite to the direction of rotation of said yarn wrapping member, so that if the rotative speeds of the yarn wrapping member and yarn winding drum selected are the maximum stable speeds, since the speed at which the yarn is wrapped around the yarn winding drum is the sum of the two speeds, 800 m/min+1200 m/min=2000 m/min can be attained; thus, the yarn winding speed can be greatly increased.

According to this invention, since the yarn wrapping member and yarn winding drum are reversely rotated to wrap the yarn around the yarn winding drum for storage, the yarn speed can be greatly increased as compared with the conventional Savi or Sulzer type and, moreover, even if the yarn speed is very high, there is no possibility of a "no-tension" condition or yarn breakage taking place; thus, the yarn can be reliably delivered at high speed.

These objects and other objects, features, aspects and advantages of the present invention will become more apparent from the following detailed description of the present invention when taken in conjunction with the accompanying drawings.

DESCRIPTION OF THE PREFERRED EMBODIMENTS AND OF THE BEST MODE OF THE INVENTION

Figure 1:
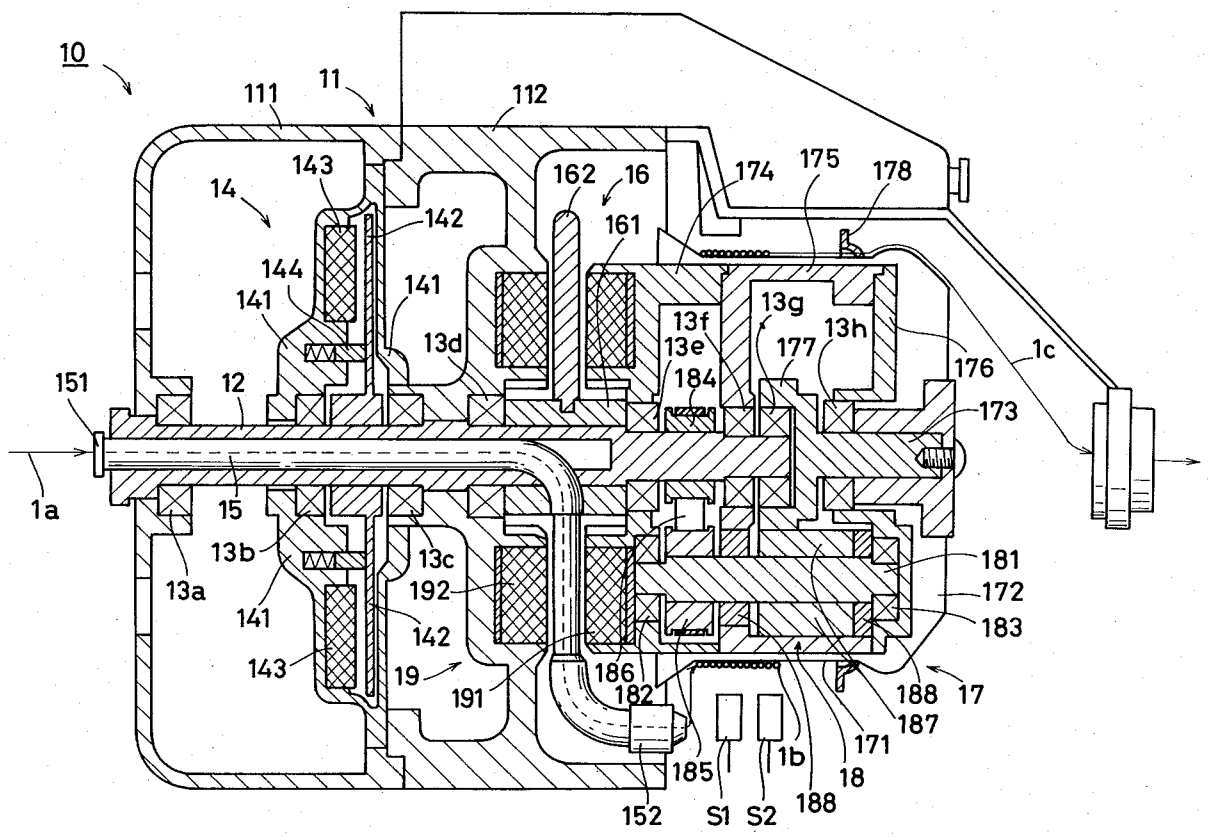
FIG. 1 is a diagrammatic view showing the sectional construction of a yarn storage and delivery apparatus according to an embodiment of this invention.

FIG. 1 is a view showing the sectional construction of a yarn storage and delivery apparatus according to an embodiment of this invention. The yarn storage and delivery apparatus 10 of this embodiment includes a housing 11 comprising first and second stationary housing portions 111 and 112 which are cylindrical or bowl-shaped and axially fitted together. In the central regions of the first and second fixed portions 111 and 112, a main shaft 12 is journaled in bearings 13*a*, 13*b*, 13*c* and 13*d* fixed to the stationary housing portions 111 and 112. The main shaft 12 is longitudinally partly hollowed. The other surface of the first housing portion 111 has the yoke or case 141 of a motor 14 fixed thereto. The motor 14 is a dc printed motor or flat motor having an armature 142 in the form of a copper disc fixed to the main shaft 12, and field poles, for example, permanent magnets 143 mounted on the yoke 141 at fixed angular intervals, for example, of 90° in opposed relation to the armature 142. There are brushes 144 abutting against the lateral surface of the armature 142. The motor 14 may, of course, be externally mounted, with pulleys and gears attached thereto to rotate the main shaft.

A portion of a yarn wrapping member 15 is inserted in the hollow portion of the main shaft 12, with one end of the yarn wrapping member 15 exposed at one end of the main shaft 12. The yarn wrapping member 15 is in the form of a pipe and bent at its portion adjacent the other side at a certain angle with respect to the main shaft 12 and bent again at a position spaced a certain distance from the center of the main shaft so that the other end 152 thereof is parallel to the main shaft 12. The portion of the main shaft 12 at which the yarn wrapping member 15 is bent is formed with a balancer 16 to balance the other end 152 of the yarn wrapping member 15. The balancer 16 comprises a cylindrical portion 161 fixed to the main shaft 12, and a balance pin 162 formed on the cylindrical portion 161 so that is is symmetrical with respect to the direction of bending of the yarn wrapping member 15. Further, the other side of the main shaft 12 is provided with bearings 13*e*, 13*f* and 13*g* which are suitably axially spaced apart.

A yarn winding drum 17 has a drum shaft 173 fixed to the central region of one lateral surface 172 of a drum-like yarn winding portion 171, and a magnet drum 174 and a gear box 175 which are integrally fixed to the inside of the yarn winding portion 171. The central portion of the magnet drum 174 is fitted on the bearing 13*e*. The central portion of the gear box 175 is fitted on the bearing 13*f*. The right-hand side surface of the gear box 175 has an end cover 176 fixed thereto. The end of the drum shaft 173 opposed to the main shaft 12 has a recess for receiving the bearing 13*g* and the outer periphery of said end has a gear 177 which forms a part of a rotating reversing transmission mechanism 18. A tension ring 178 is mounted on the yarn winding portion 171.

With the arrangement thus made, the main shaft 12 is rotatably supported in the housing 11 and rotatively driven by the rotative power of the motor 14.

The reverse rotation transmission mechanism 18 which is an example of the yarn winding drum reverse rotation drive means featuring this invention is provided in connection with the other end of the main shaft 12 and the gear 177 of the yarn winding drum 17. The reverse rotation transmission mechanism 18 in this embodiment is constructed as follows: In the gear box 175, an auxiliary shaft 181 parallel to the main shaft 12 is journaled in bearings 182 and 183. A pulley 184 is fixed on the main shaft 12 between the bearings 13*e* and 13*f*. The auxiliary shaft 181 has a pulley 185 fixed to one side thereof. A belt 186 is entrained around the pulleys 184 and 185. A gear 187 is fixed on the other side of the auxiliary shaft 181. Needle thrust bearings 188 are provided on both sides of the gear 187. The gear 187 meshes with the gear 177 associated with the drum shaft 173. The just described components reverse the rotation of the yarn winding drum 17 as will be described in more detail below.

Further, a magnetic coupling section 19 is provided in connection with the magnet drum 174 forming a coupling member and the second stationary housing portion 112. The magnet coupling section 19 comprises a plurality of permanent magnets 191 fixed to the magnet drum 174 forming said coupling member, and a plurality of permanent magnets 192 spaced a predetermined distance from the permanent magnets 191 and fixed to the second fixed portion 112. The magnetic coupling section 19 produces a magnetic attraction force between the permanent magnets 191 and 192 and thereby prevents the magnetic drum 174 or coupling member and gear box 175 from being rotated by the friction on the main shaft 12 or by the tension of the yarn being wrapped by the other end 152 of the yarn wrapping member 15. Thus, the permanent magnets 191, 192 form anchor means for said coupling member.

Sensors S1 and S2 are associated with the outer periphery of the yarn winding portion 171 and transversely spaced a certain distance from each other. The sensor S1 is a photoelectric sensor for optically detecting the amount of the yarn wrapped around the yarn winding portion 171, i.e., the amount of stored yarn, when the amount decreases to a lower predetermined value. The sensor S2 is a photoelectric sensor for detecting the amount of the yarn wrapped around the yarn winding portion 171 when the amount exceeds an upper predetermined value.

In operation, when the amount of stored yarn wrapped around the yarn winding portion 171 is small, there is no output from the sensor S2. On the basis of the absence of an output from the sensor S2, current is fed to the armature 142 to drive the armature 142. Then, the main shaft 12 and the yarn wrapping member 15 are rotated together with the armature 142. As a result, the yarn 1*a* being fed to one end 151 of the yarn wrapping member 15 is passed through the interior of the yarn wrapping member 15 to the other end 152 and is wrapped around the yarn winding portion 171 as the yarn wrapping member 15 is rotated.

At the same time, the rotative power of the main shaft 12 is transmitted to the auxiliary shaft 181 through the pulley 184, belt 186 and pulley 185. The direction of rotation of the auxiliary shaft 181 is the same as that of the main shaft 12. When the auxiliary shaft 181 is rotated in the same direction as that of the main shaft 12, the gear 187 fixed on the auxiliary shaft 181 is rotated and hence the gear 177 meshing with the gear 187 is rotated in the direction opposite to the direction of rotation of the auxiliary shaft 181. That is, the drum shaft 173 is rotated in the direction opposite to the direction of rotation of the main shaft 12 to rotate the yarn winding portion 171 in the direction opposite to the direction of rotation of the one end 152 of the yarn wrapping member 15. Thus, if the speed of the yarn being wrapped by the rotation of the main shaft 12 is selected to be about 800 m/min and if the ratio of the circumferences of the pulleys 184 and 185 is selected to be approximately equal to the gear ratio of the gears 187 and 177, then the yarn speed is the sum of the rotational speed of the main shaft 12 and the reverse rotational speed of the yarn winding drum in the direction opposite to the direction of rotation of the main shaft. Thus, there is an advantage that the feed yarn can be wrapped around the yarn winding portion 171 at a very high speed.

When the sensor S2 detects the yarn 1*b* wrapped around the yarn winding portion 171, its output interrupts the feeding of the current to the armature 142 to stop the motor 14. At this time, even if the motor 14 is stopped, the entire yarn winding drum 17, including the magnet drum 174 and gear 175, tends to rotate under its inertia of high speed rotation, but the magnetic force exerted between the permanent magnets 192 and 191 decreases the inertia of the yarn winding drum 17 to stop the latter.

The yarn 1*b* wrapped around the yarn winding drum 171 is supplied as a delivered yarn 1*c* to a weaving machine or the like through the tension ring 178. When the delivered yarn 1*c* is pulled by the weaving machine, the yarn 1*b* wrapped around and stored on the yarn winding portion 171 is gradually decreased in amount until the portion of yarn 1*b* opposed to the sensor S2 is delivered, whereupon the sensor S2 detects the absence of the yarn 1*b* to energize the armature 142. Thus, in the same manner as described above, the motor 14 is driven to rotate the main shaft 12 while rotating the yarn winding drum 17 in the direction opposite to the direction of rotation of the main shaft 12. This operation is continued as long as there is output from the sensor S2.

Thereafter, in the same manner, the motor 14 is stopped when the sensor 52 detects the presence of the yarn 1*b*, while the motor 14 is driven when the sensor S2 detects the absence of the yarn. In this manner, a constant amount of yarn is wrapped around the yarn winding portion 171 for a short time or the wrapped stored yarn is delivered.

In the illustrated embodiment, pulleys 184 and 185 and belt 186 have been used to transmit the rotative power of the main shaft 12 to the auxiliary shaft 181 while gears 187 and 177 have been provided on the auxiliary shaft 181 and drum shaft 173, respectively, to reverse the direction of the rotative power of the auxiliary shaft 181 and transmit it to the drum shaft 173. However, the mechanism for transmitting the rotative power of the main shaft 12 to the auxiliary shaft 181 may be replaced by a gearing mechanism and the mechanism for transmitting the rotative power of the auxiliary shaft 181 to the drum shaft 173 may be replaced by a pulley and belt assembly.

Figure 2:
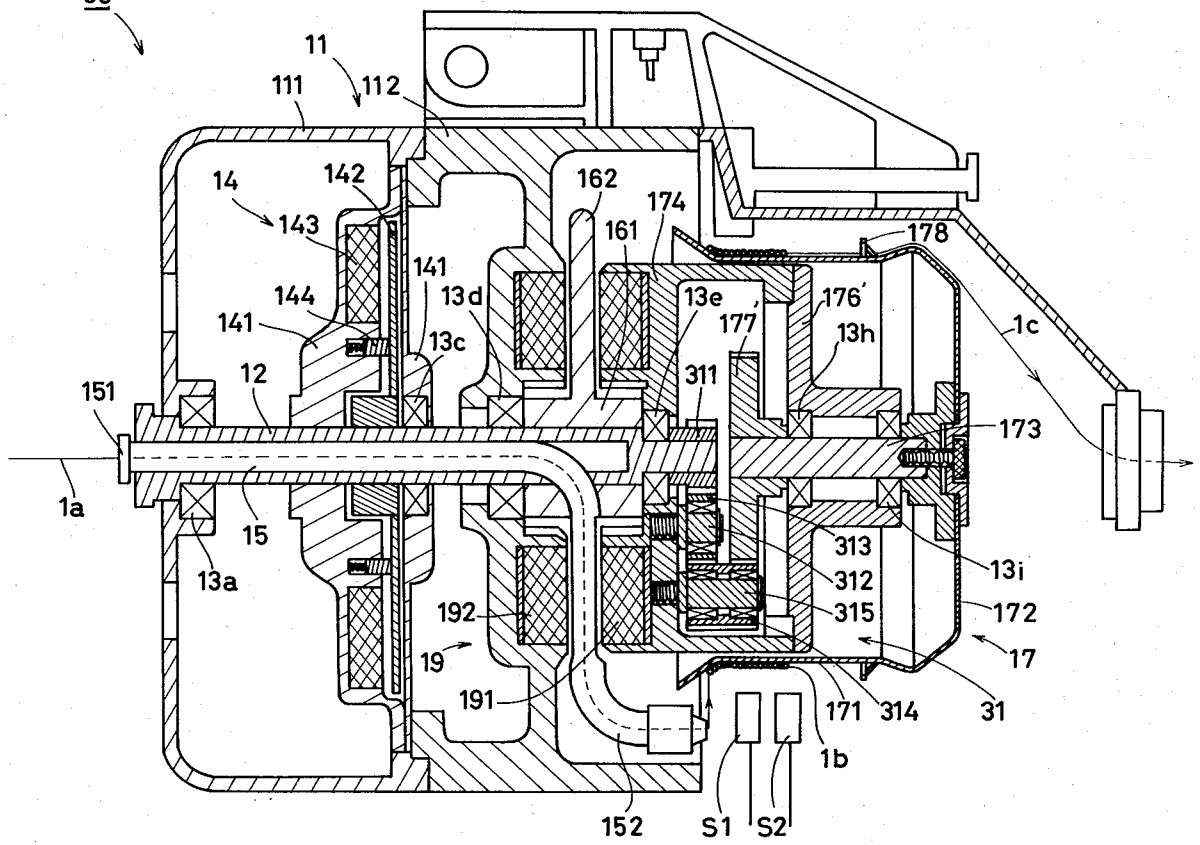
FIGS. 2 and 3 are diagrammatic views showing the sectional construction of yarn storage and delivery apparatuses according to other embodiments of the invention.

FIG. 2 is a diagrammatic view showing the sectional construction of another embodiment of a yarn storage and delivery apparatus according to this invention. The yarn storage and delivery apparatus 30 in this embodiment differs from the one shown in FIG. 1 in that the rotation reversing transmission mechanism is composed of gears alone. More particularly, the rotation reversing transmission mechanism 31 included in the yarn storage and delivery mechanism 30 of this embodiment is constructed in the following manner: One end of the main shaft 12 has a gear 311 fixed thereto. The gear 311 meshes with a gear 313 journaled on a shaft 312. The gear 313 meshed with a gear 314. The gear 314 is journaled on a shaft 315 and its teeth have a width about twice as large as the width of the teeth of the gears 311 and 313. The portion of the gear 314 not meshing with the gear 313 meshes with a gear 177' fixed on the drum shaft 173. Further, in this embodiment, the gear box is defined by the magnet drum 174 and end cove 176 cooperating with each other, and the drum shaft 173 is journaled in the bearings 13*h* and 13*i*. The reset of the arrangement is substantially the same as in FIG. 1, and the like parts are denoted by the like reference characters to avoid a detailed description thereof.

In operation, when the main shaft 12 is rotated, the gear 313 meshing with the gear 311 is rotated in the direction opposite to the direction of rotation of the main shaft 12. Further, the gear 314 is rotated in the direction opposite to the direction of rotation of the gear 313, i.e., in the same direction as that of the main shaft 12. The rotation of the gear 314 causes rotation of the gear 177' in the direction opposite to that of the gear 314. As a result, the gear 177' is rotated in the direction opposite to the direction of rotation of the main shaft 12 and the rotational power of the main shaft 12 is reversed in its direction and transmitted to the yarn winding drum 17.

Figure 3:
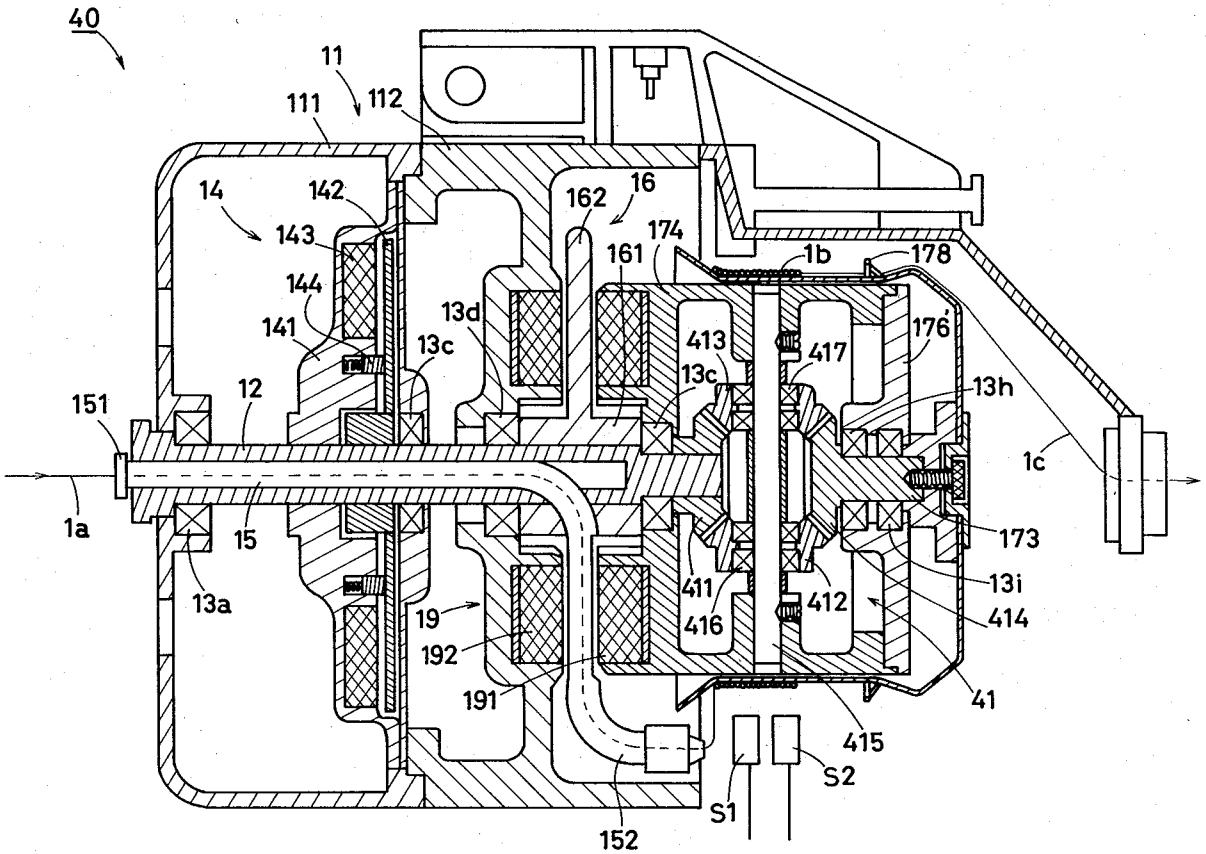

FIG. 3 is a sectional view showing the detail of a further embodiment of a yarn storage and delivery apparatus of this invention. The yarn storage and delivery apparatus 40 in this embodiment differs from the one shown in FIG. 1 in that the rotation reversing transmission mechanism 41 is composed of bevel gears. More particularly, the rotation reversing transmission mechanism 41 of this embodiment includes bevel gears 411, 412, 413 and 414. The bevel gear 411 is fixed on one end of the main shaft 12. The bevel gears 412 and 413 are journaled in bearings 416 and 417 on a shaft 415 supported orthogonally to the main shaft 12. The bevel gear 414 is supported by a drum shaft 173 positioned on an extension line from one end of the main shaft 12. The drum shaft 173 is journaled in bearings 13*h* and 13*i*. The shaft 415 is supported in an extension of the magnet box 174 forming a gear box. In addition, the rest of the arrangement is the same as in FIG. 1, and the like parts are denoted by the like reference characters to omit a detailed description thereof.

In operation, when the main shaft 12 is rotated, the bevel gear 411 is rotated integrally with the main shaft 12. The rotational power of the bevel gear 411 is changed through 90° and transmitted to the bevel gears 412 and 413. The rotation of the bevel gears 412 and 413 causes rotation of the bevel gear 414. The direction of rotation of the bevel gear 414 is opposite to the direction of rotation of the main shaft 12. Thus, the direction of the rotational power of the main shaft 12 is reversed and transmitted to the drum shaft 173, thereby rotating the yarn winding drum 17 in the opposite direction.

The above embodiments refer to the case where the rotational power of the main shaft 12 is transmitted to the yarn winding drum 17 by using a mechanical rotation reversing transmission mechanism; however, it is possible to electrically reverse the direction by providing a small-sized motor for independently rotating the yarn winding drum in the direction opposite to the direction of rotation of the main shaft 12.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A yarn storage and delivery apparatus for storing and delivering a supplied yarn, comprising: a main shaft having a hollow portion, first means supporting said main shaft for rotation about a main axis, a motor for rotatively driving said main shaft, a yarn winding drum having a rotational drum shaft with a drum axis of rotation lying in an extension of said main axis of said main shaft, and second means supporting said drum axis for rotation, a coupling member (174, 176) arranged for rotatably bridging said main shaft and said rotational drum shaft of said yarn winding drum and for rotationally coupling said main shaft and said yarn winding drum, a yarn wrapping member driven by said main shaft and having one end extending through said hollow portion of said main shaft and positioned at one end of said main shaft, said yarn wrapping member having another bent end adjacent the other side of said main shaft, whereby said yarn wrapping member is positioned in opposed relation to a portion of an outer periphery of said yarn winding drum so that during rotation of the yarn winding drum a yarn supplied by one end of said yarn wrapping member is wrapped around the yarn winding drum, yarn winding drum reverse rotation drive means supported by said coupling member and responsive to the rotational force of said main shaft for generating a rotational force in a direction opposite to the direction of rotation of said main shaft for transferring said reverse rotational force to said rotational drum shaft, and anchoring means (191, 192) for holding said coupling member and said yarn winding drum reverse rotation drive means in a substantially stationary state for preventing said coupling member and said yarn winding drum reverse rotation drive means from being rotated about said main shaft and about said rotational shaft of said yarn winding drum by the rotation of said main shaft or of said yarn winding drum, whereby the winding of yarn takes place by said motor with a speed which is the sum of the rotational speed of the yarn winding drum in one direction and the rotational speed of said wrapping member in the other direction.

2. The yarn storage and delivery apparatus of claim 1, wherein said yarn winding drum reverse rotation drive means include a reverse rotation transmission mechanism for reversing the direction of rotation of said main shaft and for driving said yarn winding drum opposite to said main shaft rotation.

3. The yarn storage and delivery apparatus of claim 2, wherein said reverse rotation transmission mechanism is arranged in parallel to said main shaft and includes pulleys, a belt and gears for reversing the direction of rotation of said main shaft and for driving said yarn winding drum opposite to said main shaft rotation.

4. The yarn storage and delivery apparatus of claim 2, wherein said reverse rotation transmission mechanism is arranged in parallel to said main shaft and includes a plurality of gear means for reversing the direction of rotation of said main shaft and for driving said yarn winding drum opposite to said main shaft rotation.

5. The yarn storage and delivery apparatus of claim 2, wherein said reverse rotation transmission mechanism comprises a first bevel gear fixed on the other end of said main shaft, a second bevel gear meshing with said first bevel gear and journaled on an axis extending orthogonally to said main shaft, and a third bevel gear meshing with said second bevel gear and journaled axially of said main shaft and adapted to be rotated in the direction reverse to the direction of rotation of the main shaft for driving said yarn winding drum opposite to said main shaft rotation.

6. The yarn storage and delivery apparatus of claim 1, wherein said first means for supporting said main shaft comprise a housing, and wherein said anchoring means for holding said coupling member comprise a magnetic coupling section for preventing the inertial rotation of the yarn winding drum.

* * * * *